United States Patent [19]

Schönwald et al.

[11] 4,204,802

[45] May 27, 1980

[54] SIDE CHANNEL COMPRESSOR

[75] Inventors: Siegfried Schönwald; Norbert Schmid, both of Bad Neustadt, Fed. Rep. of Germany

[73] Assignee: Siemens Aktiengesellschaft, Berlin and Munich, Fed. Rep. of Germany

[21] Appl. No.: 933,557

[22] Filed: Aug. 14, 1978

[30] Foreign Application Priority Data

Aug. 24, 1977 [DE] Fed. Rep. of Germany ..... 2738208

[51] Int. Cl.[2] ..... F04D 5/00; F04D 29/18

[52] U.S. Cl. ..... 415/213 T; 415/198.2

[58] Field of Search ..... 415/53 T, 213 T, 198.2

[56] References Cited

U.S. PATENT DOCUMENTS

| | | | |
|---|---|---|---|
| 2,283,844 | 5/1942 | Brady, Jr. | 415/213 T |
| 2,817,296 | 12/1957 | Fabig | 415/213 T |
| 3,133,505 | 5/1964 | Heerens et al. | 415/213 T |

FOREIGN PATENT DOCUMENTS

| | | | |
|---|---|---|---|
| 1945979 | 8/1977 | Fed. Rep. of Germany | 415/53 T |

*Primary Examiner*—Leonard E. Smith

*Attorney, Agent, or Firm*—Kenyon & Kenyon

[57] ABSTRACT

In a side channel compressor, the blades arranged on the rotor are provided with a bevel on the back side of the blade at their lateral edges and the output characteristic can be changed by providing a slot-like recess at the blade edges in the entrance region of the blades. If required, such slot-like recess can be made as a retrofit.

2 Claims, 2 Drawing Figures

SIDE CHANNEL COMPRESSOR

BACKGROUND OF THE INVENTION

This invention relates to side channel compressors in general and more particularly to such compressors in which the output characteristic can be changed.

Side channel compressors in which the blades arranged on a rotor have a bevel on the back side of the blades at their lateral edges are generally known. As is further known, the power required in side channel compressors increases if the amount of throttling is increased, and reaches its maximum if the side channel compressor is throttled completely. There are various applications for side channel compressors, in which the latter are also temporarily throttled completely between the normal pumping operation. Since the side channel compressor consumes the most power just when no pumping is necessary, various solutions have already become known to reduce this power in case of complete throttling. One possibility is to connect a pressure limiting valve to the side channel compressor. This, however, requires additional technical means and is expensive.

From the German Offenlegungsschrift No. 1,945,979, FIG. 5, it is known to provide a bevel on the front side of the blade in addition to a bevel on the back side of the blade, to reduce the power of a side channel compressor when it is completely throttled. Another possibility for reducing the power in the completely throttled state is seen in providing sharp deflections in the side channel and at the blade bases. Such mechanical design in a side channel compressor must be taken into consideration from the start in the manufacture of the side channel compressor. This means that such side channel compressors must be designed and manufactured specially for the applications described.

From the German Auslegeschrift No. 1,528,822, FIGS. 3 and 4, a side channel compressor is further known, in which guide ribs are arranged for reducing the power required with increased throttling. Such guide ribs must likewise be provided right from the start, so that this known side channel compressor is specifically designed for such applications where throttling takes place temporarily.

In many applications, however, no throttling of the side channel compressor takes place during operation, so that power limitation in general is not necessary. Since the known measures for limiting power result in a certain amount of efficiency reduction, general employment of side channel compressors designed in this manner is not desirable. So as to always offer optimum efficiency for operation of the side channel compressor with full throttling, as well as for operation of the side channel compressor without throttling, the manufacturer of side channel compressors must practically have two difference types of side channel compressors in his line.

SUMMARY OF THE INVENTION

It is an object of the present invention to design a side channel compressor in such a manner that its output characteristic can be changed by measures which can be performed as a retrofit.

According to the present invention, the solution of the stated problem is possible in a side channel compressor of the type described at the outset by providing a slot-like recess in the entrance region of the blades at each blade edge. If required, such recesses can still be provided at the lateral edges of the blades of the finished rotor subsequently (as a retrofit). This has the advantage that the same basic design of the side channel compressor can be used for all applications and the manufacturer therefore needs only one type of side channel compressor. According to one embodiment of the invention, especially good separation of the flow is obtained if the axial depth of the slot-like recess corresponds approximately to the axial width of the bevel.

DETAILED DESCRIPTION OF THE INVENTION

Figure 1:
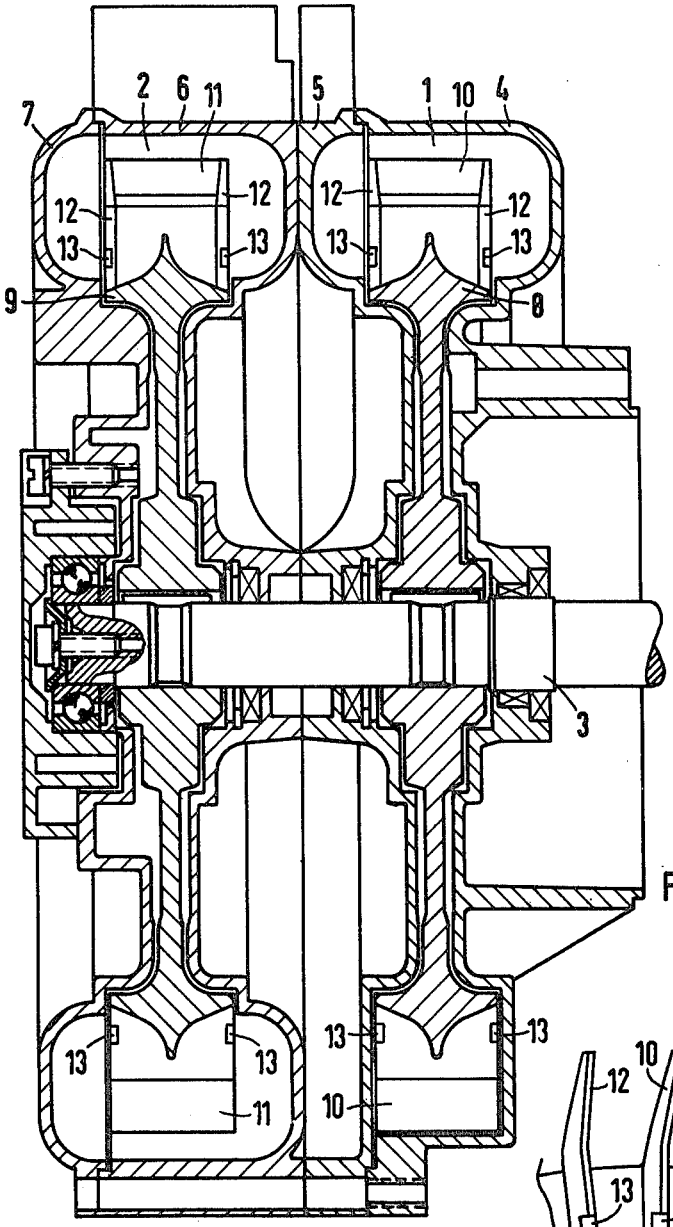
FIG. 1 shows a cross section of a side channel compressor.

In FIG. 1, compressor stages arranged on a common shaft 3 are designated as 1 and 2. The housing of compressor stage 1 consists of an outer housing half 4 and an inner housing half 5; likewise, the housing of compressor stage 2 consists of an inner housing half 6 and an outer housing half 7. Blade wheels 8 and 9 are arranged in the respective housings of the compressor stages. The blades 10 and 11 connected to the blade wheels 8 and 9 have bevels 12 on the back side of the blade. Slot-like recesses 13 are provided in the entrance region of the blades 10 and 11.

Figure 2:
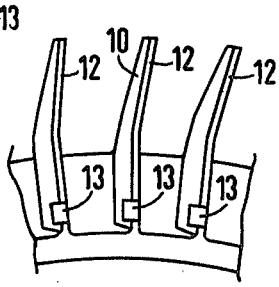
FIG. 2 illustrates several blades of the rotor of the compressor of FIG. 1 in a side elevation.

FIG. 2 shows a side elevation of several blades. As is seen therefrom, these blades are slightly curved in their radial, outer portion in the direction of travel. At the lateral edges, the bevel 12 on the back side of the blade and the slot-like recess 13 are seen.

In a side channel compressor, the pressure produced is determined, among other things, also by the profile of the lateral edges. The profile of the lateral edge is changed by the slot-like recess in the entrance region of the blades. As a result, the effect of the original profile predominates for a larger volume flow, i.e., at higher pressure, a partial flow separation at the lateral edges of the blades, which prevents the pressure from increasing further, is forced by the slot-like recesses. Through the size and position of the slot-like recess in the entrance region of the blade, the pressure produced and, thereby, the bend in the compressor characteristic in the upper pressure range can be varied in a simple manner.

What is claimed is:

1. In a side channel compressor, having blades arranged on a rotor said blades having a bevel on the back side at their lateral edges, the improvement comprising a slot-like recess at each blade edge in the entrance region of the blades.

2. The improvement according to claim 1, wherein the axial depth of said slot-like recess corresponds approximately to the axial width of the bevel.

* * * * *